US005801345A

United States Patent [19]

Mikula-Curtis et al.

[11] Patent Number: 5,801,345

[45] Date of Patent: Sep. 1, 1998

[54] KEYBOARD ASSEMBLY INCORPORATING MULTIPLE LIGHTING MODES FOR IMPROVED USER FEEDBACK

[75] Inventors: Anastasia M. Mikula-Curtis, Saratoga; Richard W. Henderson, Fremont; Randal J. Bertuccelli, Mount Aukum; Gary A. Arndt, Folsom, all of Calif.

[73] Assignee: Acuson Corporation, Mountain View, Calif.

[21] Appl. No.: 667,194

[22] Filed: Jun. 21, 1996

[51] Int. Cl.[6] ..... H01H 9/16

[52] U.S. Cl. ..... 200/5 A; 200/314; 200/317

[58] Field of Search ..... 200/5 R, 5 A, 200/512, 517, 308–317, 329, 336, 339, 341; 341/20–23

[56] References Cited

U.S. PATENT DOCUMENTS

| | | | |
|---|---|---|---|
| 4,683,359 | 7/1987 | Wojtanek | 200/314 |
| 4,772,769 | 9/1988 | Shumate | 200/314 |
| 4,778,966 | 10/1988 | Obata et al. | 200/314 |
| 4,954,675 | 9/1990 | Iwata et al. | 200/317 |
| 5,464,955 | 11/1995 | Cole | 200/317 |
| 5,612,692 | 3/1997 | Dugas et al. | 341/22 |

*Primary Examiner*—Cassandra C. Spyrou
*Assistant Examiner*—Michael A. Friedhofer
*Attorney, Agent, or Firm*—Ladas & Parry

[57] ABSTRACT

A keyboard assembly incorporating multiple lighting modalities is disclosed herein. In one lighting mode, discrete indicator lights are embedded in the actuator keys to signify the state of an associated function. In a second mode, a plurality of legends, each sufficiently proximate to an associated function actuator key, are illuminated. In accordance with one embodiment of the present invention, function indicator lights in the actuator keys provide real-time user feedback such that scrolling through numerous display screen menus to determine availability of a desired function may be eliminated. Further, the backlit actuator legends enhances usability of system in low light clinical environments during ultrasound exams making the function actuator keys easy to locate. In addition, the backlit legends increases the contrast in high ambient light environments for improved readability. The combination of design features disclosed provides a relatively inexpensive, long lasting keyboard assembly that provides improved user feedback for more efficient operation.

18 Claims, 6 Drawing Sheets

KEYBOARD ASSEMBLY INCORPORATING MULTIPLE LIGHTING MODES FOR IMPROVED USER FEEDBACK

This application is filed in relation to a disclosure accorded the priority date of Apr. 24, 1996 filed under the Disclosure Document Program Entitled: Elastomeric Keyboard Assembly With Integrated Lighting, Discrete Actuators Plated Key Pads.

FIELD OF INVENTION

The present invention relates generally to keyboard assemblies for electronic and computer equipment. In particular, it pertains to a keyboard assembly that incorporates function indicator lights in individual actuator keys and backlit legends for improved user feedback.

BACKGROUND OF THE INVENTION

The widespread use and increasing complexity of electronic equipment often requires the use of data entry on the part of the user for efficient operation. One widely used peripheral for entering data is through a keyboard. A wide variety of keyboards are implemented for various applications such as personal computers, medical ultrasound equipment, test equipment, point of sale machines etc. Each application has its own particular requirements for optimizing keyboard arrangement for functionality and feedback for efficient operation.

One way keyboards are manufactured is by hard mounting a plurality of discrete mechanical switches wherein each key has its own spring-like switch mechanism that returns the key to its original position from a depressed state. In general, keyboards utilizing this type of implementation are reliable and provide good tactile feedback to the user but are relatively expensive and complex to manufacture.

Another implementation, which is more cost effective and efficient for manufacturing, is to use a rubber-like (elastomer) membrane having a plurality of dome-like structures molded therein to support the keys in their upright state. When the key is depressed, the domes are designed to collapse and come into contact with a prealigned electrically conductive switch pad formed on a printed circuit board (PCB). Contact with the switch pad from a conductive element on the underside of the dome effectively electrically connects the traces that make up the switch pad thereby generating a signal that is sensed by a microprocessor to identify the key. One popular method of fabricating the conductive traces of a switch pad is by a carbon screening process because of the relative low cost for capital equipment and low per piece part cost. The screening process involves placing a template over the PCB, where a carbon mixture is deposited in exposed areas of a template in a single swipe. Although the process is efficient, it has the disadvantage of being a low tolerance process where a slight misalignment of the screen over the PCB can result in non-operable switch. A further disadvantage is that the carbon mixture can be prone to bleeding, i.e., neighboring traces can be inadvertently shorted from the overflow of the carbon during screening process. This becomes more of a problem when forming relatively small switch pads with closely spaced traces. Another disadvantage is that the carbon screened switch pad tends to wear out relatively quickly with repeated contact thus limiting the life of the keyboard.

For specialized applications such as medical ultrasound equipment, it is desirable for the keyboards to be long-lasting, arranged for optimal functionality, and to provide efficient feedback to the user. By way of example, as ultrasound equipment becomes increasingly complex with increasing numbers of functions built-in, it is desirable to permit direct access and execution of these functions through an actuator key. This eliminates the need to inefficiently scroll through numerous on-screen display menus to locate or execute a desired function. Therefore, a primary objective is to design a keyboard that may contain a large number of discrete keys that are easy to find and easy to use. In view of the above objective, it is desirable to include backlit legends located near enough to the associated keys such that the desired function can be quickly located and easily executed. Legends that are backlighted allow for easy key identification in low ambient light conditions, such as during ultrasound exams. A further improvement would be to provide an option to incorporate discrete indicator lights into the individual actuator keys that can signify the current functional state of a programmed function associated with the key.

The present construction of conventional keyboards make them inherently unsuitable for incorporating the lighting modalities as described above. Further, the spacing requirements for locating the both the backlit legends proximate to the key switch pad operating in conjunction with indicator lights in individual actuator keys is not taught in the prior art. In addition, prior art keyboards utilizing discrete mechanical switches or rubber membranes, as taught, do not have room to meet the spacing requirements for incorporating these lighting components.

One type of keyboard backlighting technique is disclosed in U.S. Pat. No. 4,772,769 and issued to Shumate on Sep. 20, 1988. Shumate teaches the backlighting of selective keys which can be used to indicate when a key is properly depressed or the status of a function controllable by the key, as described on col. 1, lines 15–19 in the specification. The backlighting is provided by a plurality of light emitting diodes (LEDs) whose light is directed through associated translucent key caps, as described in col. 2, lines 12–24. This mode of lighting is inadequate for the objectives outlined above since the relative small size of the key cap limits the length of titles that can be displayed to adequately describe functions. Further, the structure of Shumate and the prior art are such that they are not designed to accommodate multiple lighting modalities as described.

Accordingly, it is a general objective of the present invention to provide a method and apparatus for an improved keyboard assembly incorporating the lighting modalities in accordance with the above described objectives that does not significantly increase cost, complexity, manufacturing time, or part count of the assembly.

SUMMARY OF THE INVENTION

To achieve the foregoing and other objectives in accordance with the purpose of the present invention, a keyboard assembly incorporating multiple lighting modes for enhancing user feedback is disclosed herein. In accordance with a preferred embodiment, the keyboard assembly includes a main bezel having a plurality of receptacles for the operation and retention of actuator keys. In addition, a plurality of light dams associated with each actuator key are formed into the main bezel. A printed circuit board (PCB) with an array of prearranged light holes for allowing light from LEDs attached to the bottom surface of the PCB to emanate through. A plurality of prearranged switch pads are mounted on the top surface of the PCB. A rubber-like elastomer layer is sandwiched between the main bezel and the PCB. The elastomeric layer includes a plurality of corresponding resilient elastomer domes and light boots formed thereon. When a key is depressed, the elastomer dome buckles to make contact with an associated switch pad thereby generating a detectable signal. The end of a light pipe slidably engages into the light boot when the key is depressed such that light from an indicator LED is transmitted through the light pipe to the other end. The light passes through the light pipe and is observed through the opening at the top of the key.

In a method aspect of the present invention, a keyboard is assembled to enhance user feedback by incorporating at least two light modes. A first light mode is provided by incorporating an indicator light in the actuator keys to indicate a state of an associated function. A second light mode is provided by including a plurality of backlit functionally descriptive legends in close proximity to the actuator keys.

BRIEF DESCRIPTION OF THE DRAWINGS

The invention, together with further objects and advantages thereof, may best be understood by reference to the following description taken in conjunction with the accompanying drawings in which.

DETAILED DESCRIPTION OF THE PREFERRED EMBODIMENTS

Figure 1:
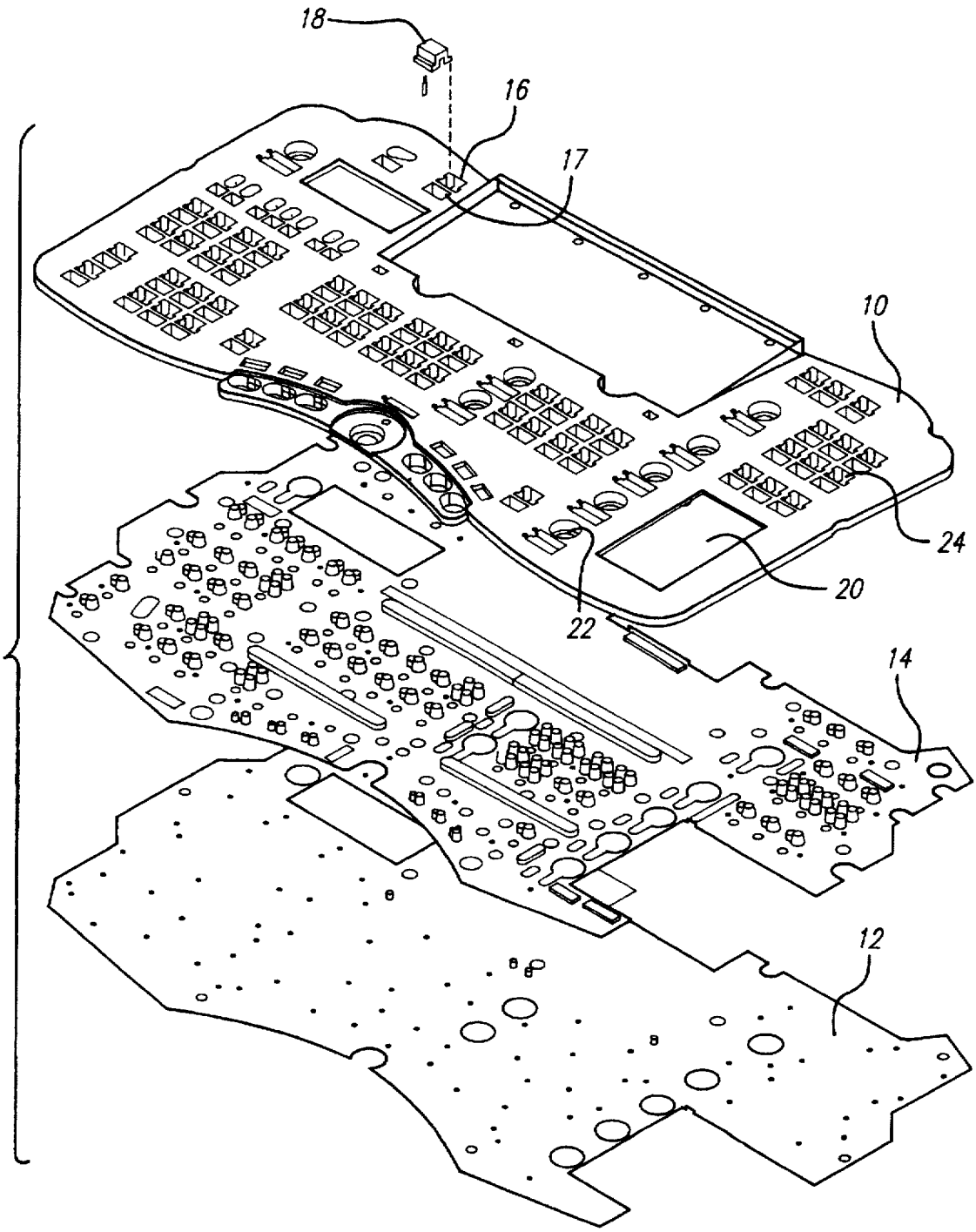
FIG. 1 is expanded view of a keyboard assembly in accordance to a preferred embodiment of the present invention.

Referring initially to FIG. 1, an expanded view a keyboard assembly for a medical ultrasound device in accordance with a preferred embodiment of the present invention is shown. The keyboard assembly incorporating multiple lighting modes is formed from three primary components i.e. main bezel 10, a printed circuit board (PCB) 12, and an elastomer layer 14 sandwiched in between main bezel 10 and PCB 12. Main bezel 10 includes a multiplicity of receptacles formed therein, such as receptacle 16, in which actuator key 18 slidably operates and is retained therein. Light dams, such as light dam 17, are formed into main bezel 10 for each associated actuator key. The light dams are located substantially proximate to an associated actuator key and serve to channel light emanating from the bottom of the keyboard through a translucent legend overlay. The legend overlay, with its precut openings, is conveniently placed over the keycaps thereby simultaneously covering the light dams such that the light emanating from the dams illuminates the legends. Other openings 20, 22, and 24 are formed into bezel 10 for such control mechanisms as slider controls, knobs and rocker switches respectively.

Figure 2:
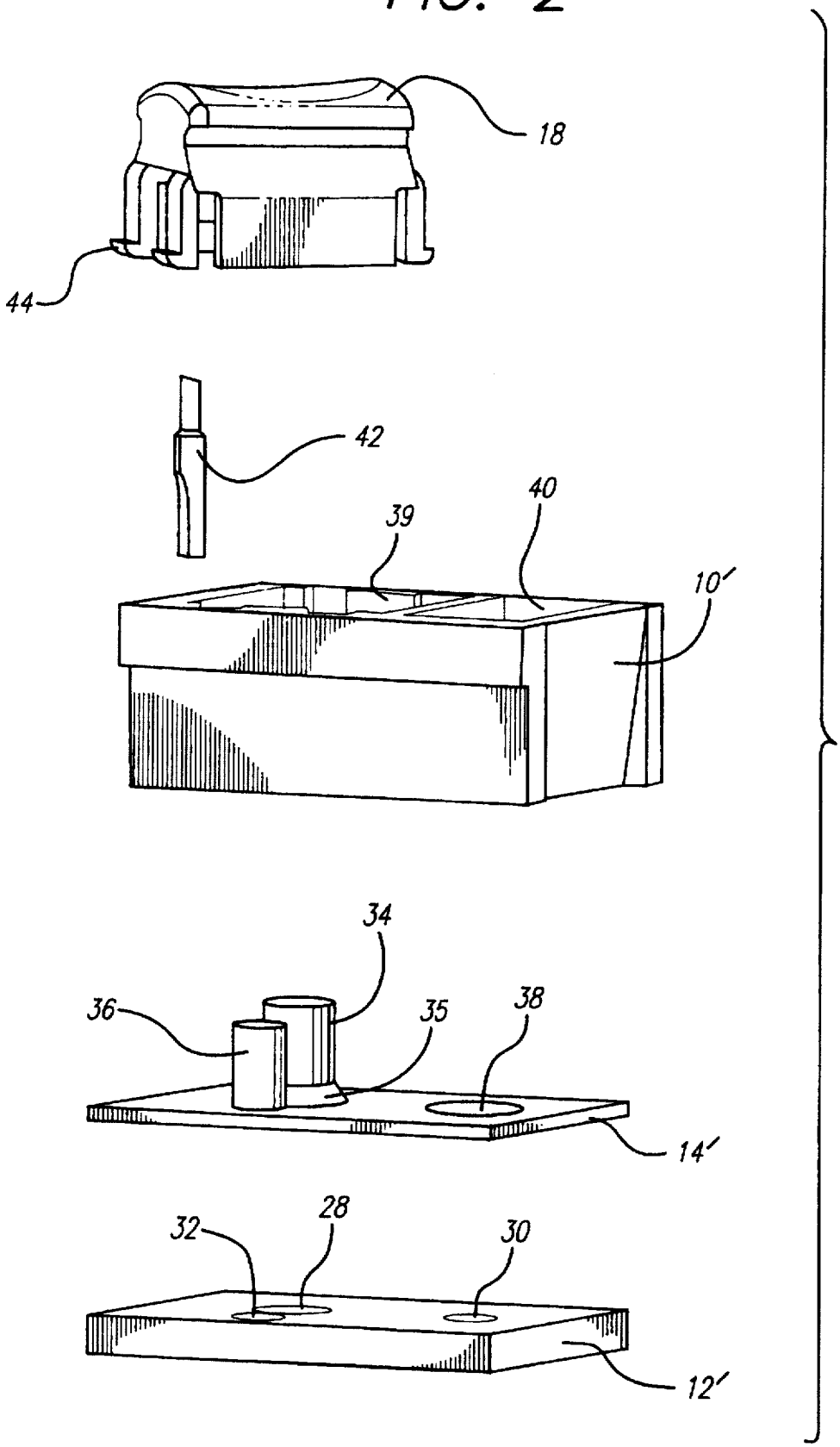
FIG. 2 is expanded view of a single keycap unit in accordance to a preferred embodiment of the present invention.

FIG. 2 shows an expanded view of the inner constituents involved in the operation of actuator key 18. A single function key unit is shown for simplicity since all other actuator keys have substantially similar construction. It should be noted hereinafter that a primed reference numeral denotes a sectional unit of an individual key station of their respective unprimed elements in FIG. 1. In FIG. 2, PCB 12' includes switch pad 28, a first light hole 30 to permit the upward emanation of light from a backlight light emitting diode (LED) mounted to the bottom surface of PCB 12'. A second light hole 32 is formed for the emanation of light from an indicator LED. Elastomer 14' has formed therein a dome 35 that is designed to buckle when a key is depressed which makes contact with the traces of switch pad 28. A solid support post 34 provides an extension from the top of dome 35 to the actuator key. When the downward force is removed, dome 35 recoils upward pushing post 34 upward to return the key to its rest state. The force required to depress t he key may be varied by adjusting the thickness walls of dome 35. In the preferred embodiment, the thickness is varied until a resistance of about 120 grams is achieved.

Further for med into elastomer 14' is a molded light boot 36 and a light dam hole 38. Boot 36 is directly positioned and vertically aligned on top of light hole 32 of PCB 12'. Boot 36 is a hollow cylindrical tube that channels light emanating from hole 32 into a light pipe that slides within the boot 36. Boot 36 also prevents the light from bleeding into adjacent key stations. Light dam hole 38 permits the emanation of light to flow upwards unimpeded from hole 30. Fitting directly over elastomer 14' is main bezel 10' having a receptacle socket 39 for receiving an actuator keycap. A light dam 40 is molded into main bezel 10' which serves to provide a method for evenly spreading the light emanating from hole 30. The spreading light impinges on the back plane of a legend that covers the opening of dam 40 thereby illuminating the legend. A light pipe 42 is slidably engaged in boot 36 which acts as a light guide to efficiently transmit light emanating from hole 32. The light is transmitted through the lightpipe and emerges from the top of the light pipe. Actuator keycap 18 is pressed into socket 39 of bezel 10' and is slidably restrained within socket 39. Hooks 44 prevent the keycap 18 from being dislodged from the main bezel 10' yet allows for removal from topside for service or replacement. Light pipe 42 is pressed into a hole in the keycap such that the top of light pipe 42 is exposed through and flush with the keycap surface.

Figure 3:
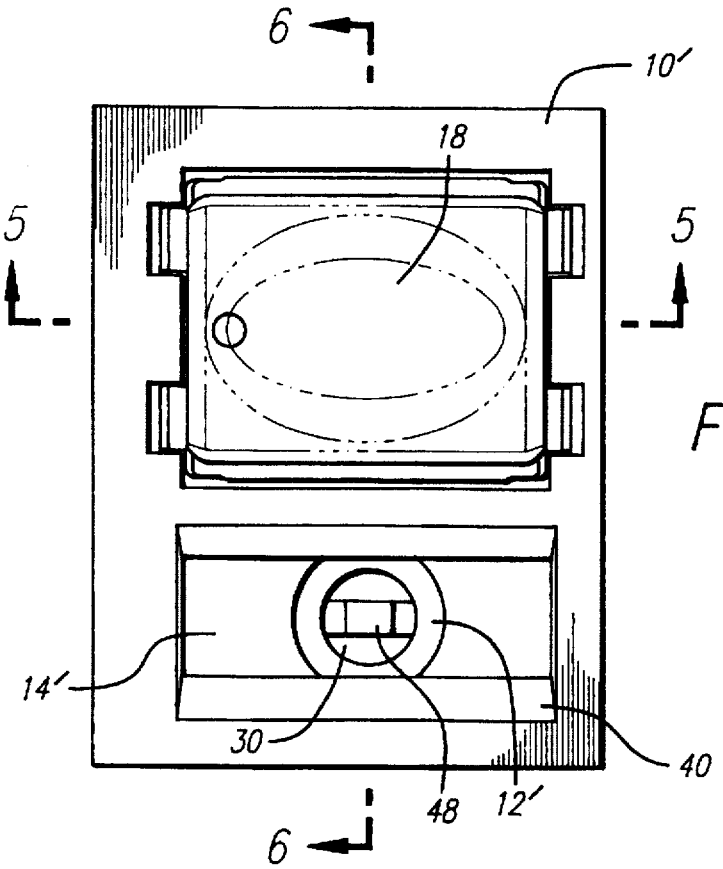
FIG. 3 is diagrammatic top view of the keycap unit in FIG. 2.

FIG. 3 shows a top view of keycap 18 fitted into the receptacle of main bezel 10'. An LED 48 is surface mounted to the bottom surface of PCB 12' such that the generated light emanates upward through hole 30 in PCB 12'. Elastomer 14' is sandwiched between the PCB 12' and bezel 10' such that light dam 40, having outwardly sloping walls from bottom to top, spreads the light.

Figure 3A:
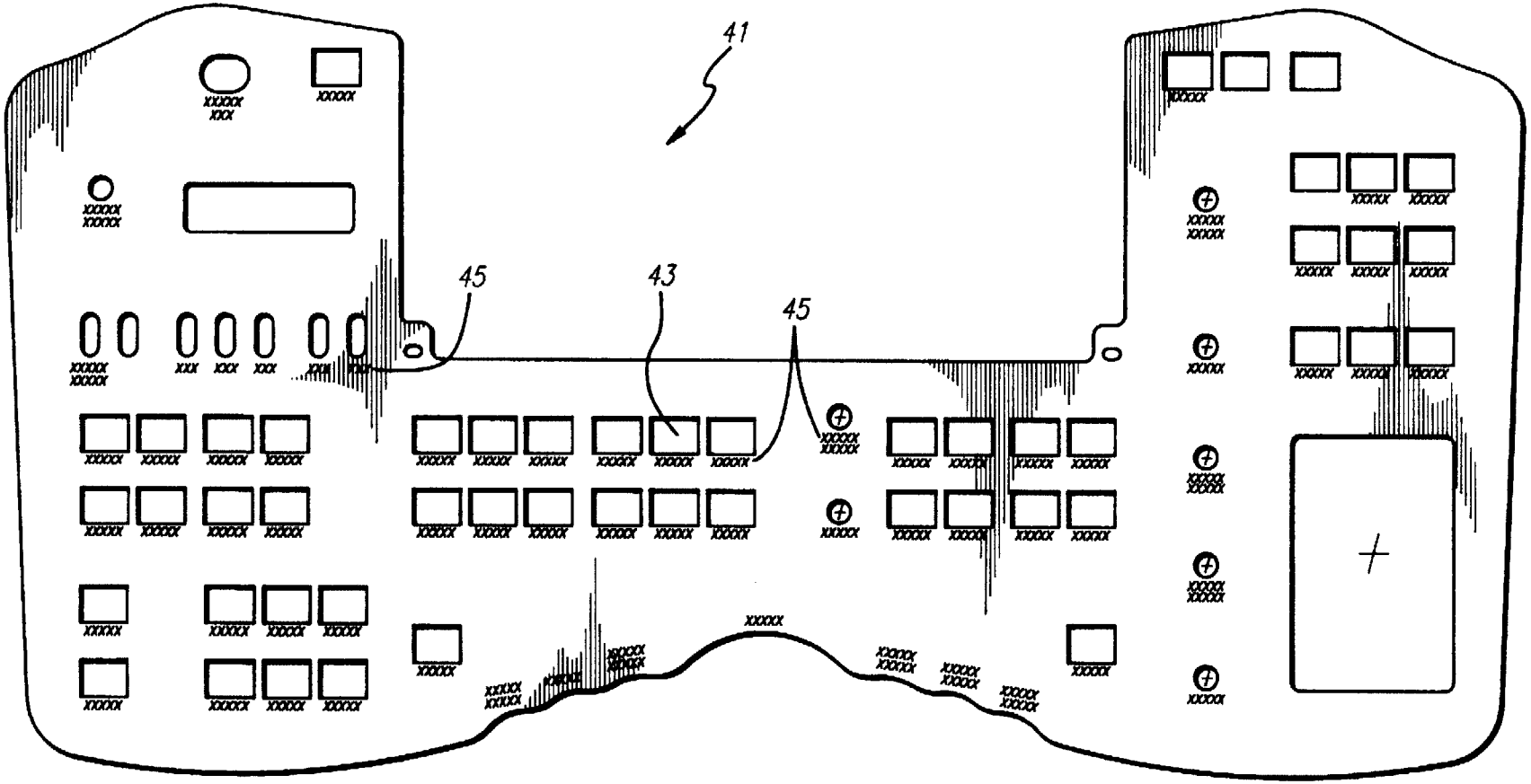
FIG. 3*a* is a plan view of a translucent legend overlay.

FIG. 3*a* shows a translucent legend overlay having cutout sections 43 for keycaps to fit through, is placed over the top of the bezel 10 (FIG. 1). Functional titles, such as 45, are screened on the overlay 41, all of which, are directly aligned over their associated light dams. The titles 45 are illuminated from light generated from LED 48 (FIG. 3). The backlit legends also help to increase contrast for improved readability in high ambient light conditions, in addition to aiding in low ambient light conditions.

Figure 4A:
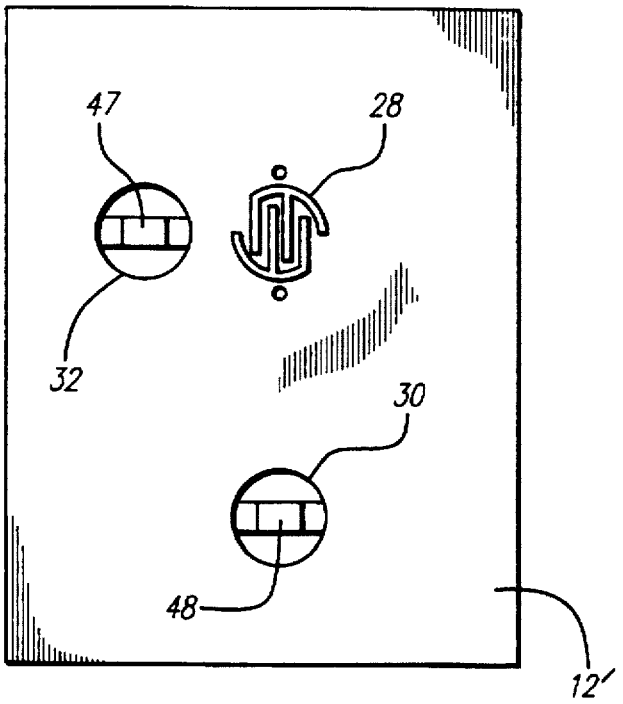
FIG. 4*a* is a diagrammatic top view of the PCB segment in FIG. 2.
Figure 4B:
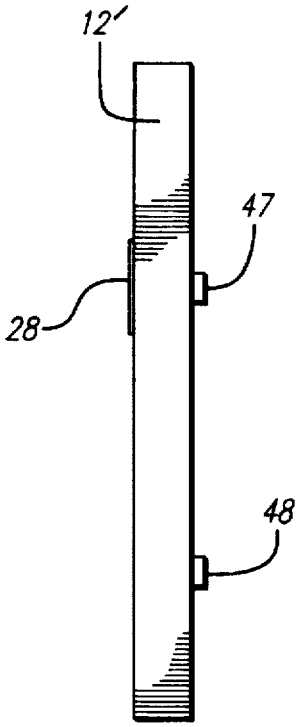
FIG. 4*b* is a diagrammatic side view of the PCB segment in FIG. 4*a;*

FIG. 4*a* shows a top view of PCB 12' and the spatial relationship between the various elements required to incorporate the lighting modalities in accordance with the present invention. An important aspect of the present invention is the relative close proximity of the lighting elements from switch pad 28. In accordance with a preferred embodiment, the center of indicator LED 47 is positioned directly beside at about 0.225 inches from the center of switch pad 28. This relatively small gap is significant since the light from LED 47 is channeled into the keycap as the function indicator light and must therefore be close enough to switch pad 28 to lie within the keycap perimeter. To backlight the legend, backlight LED 48 is positioned at about 0.482 inches directly below switch pad 28 such that the legend is sufficiently near the actuator key to be logically associated with it. It should be apparent to those skilled in the art that the dimensions may be modified to fit within the confines of the of the particular keycap used.

The LEDs are surface mounted to the bottom surface of PCB 12' such that the ensuing light emanates upwards through openings 30 and 32 in PCB 12'. It is not a requirement that the LED be mounted on the bottom surface but such attachment provides quick and efficient assembly by conventional reflow soldering techniques. Further, mounting of LEDs on the bottom surface allows for a smooth continuous top surface for flush contact with elastomer 14. Given the relatively small dimensions, it is necessary that switch pad 28 be precisely constructed from a high tolerance process. In accordance with a preferred embodiment, the copper (Cu) traces of switch pad 28 are electroplated with a low-stress sulfamate Ni (nickel) to about 300 mils in thickness. The Ni plating is followed by a hard Au (gold) plating of about 50 mils thick on top of the Ni. The Ni plating serves two purposes; it provides a diffusion barrier between the copper and the g old; and it provides improved wear resistance to the repeated mechanical cycling from the pressing of keys. Further, the plating process in general, and the Ni/Au plating in particular, provides a much higher tolerance as compared to the process of coating carbon over the Ni. Since the carbon screening process is not as precise as plating, it may lead to electrical switch failures. This is because plating does not bleed or fan in the way that carbon screening does. Another advantage the Ni/Au plating is its resistance to slivering. Slivering is caused by the undercutting (overetching) of the Cu which creates a Ni overhang that can break off and electrically short the traces after repeated mechanical cycling. Also, the wear resistance attributes of the Ni/Au plating provides a much longer lifespan of the switch pad as compared to those coated with carbon, e.g. a service life of 10 years or more can often be achieved.

FIG. **4*b* is a side view of PCB 12' showing LEDs 47 and 48 mounted to the bottom surface of PCB 12' wherein the relative position of switch pad 28 is shown on the top surface of PCB 12'**.

Figure 5:
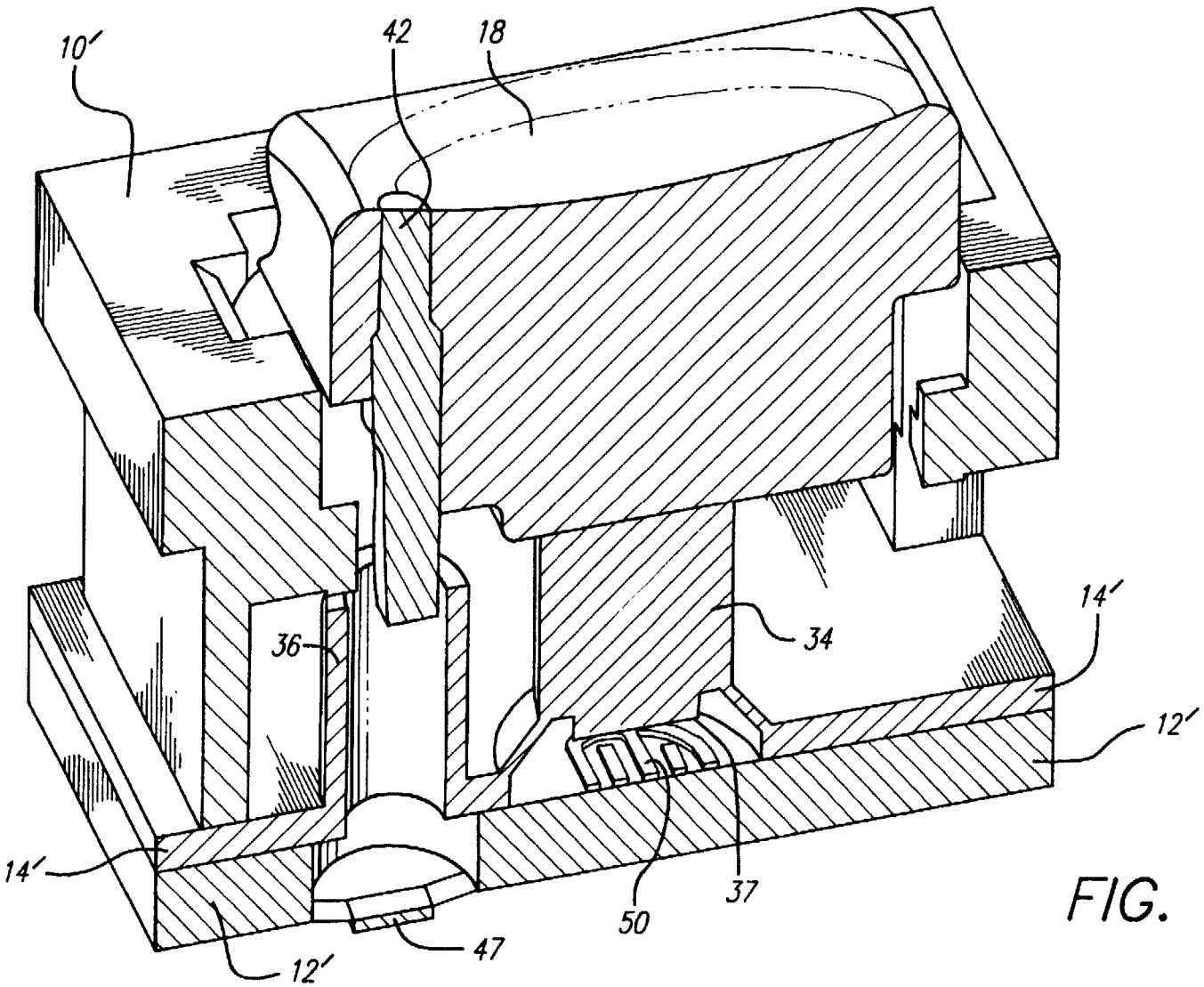
FIG. 5 is a width-wise cross sectional perspective of an assembled keycap unit.

In FIG. 5, a width-wise cross sectional perspective view of an assembled keycap unit taken along line A—A is shown. Keycap 18 is slidably engaged and retained in receptacle in main bezel 10'. Light pipe 42 is press fit into keycap 18 such that the top of the light pipe is exposed for light to be seen by the user. As keycap 18 is depressed, support post 34 moves downward forcing a conductive element 37 in contact with switch pad 28 to generate a signal detectable by the system. Simultaneously, the bottom of light pipe 42 slides in light boot 36 molded into elastomer 14'. The light boot 36 channels and directs the light generated by indicator LED 47 into the light pipe thereby preventing the bleeding of light into neighboring units. The state of the function is determined by internal software which accordingly activates indicator LED 47 to indicate the current state to the user. For example, indicator LED 47 may be turned on when the function is available and turned off when it is unavailable.

Figure 6:
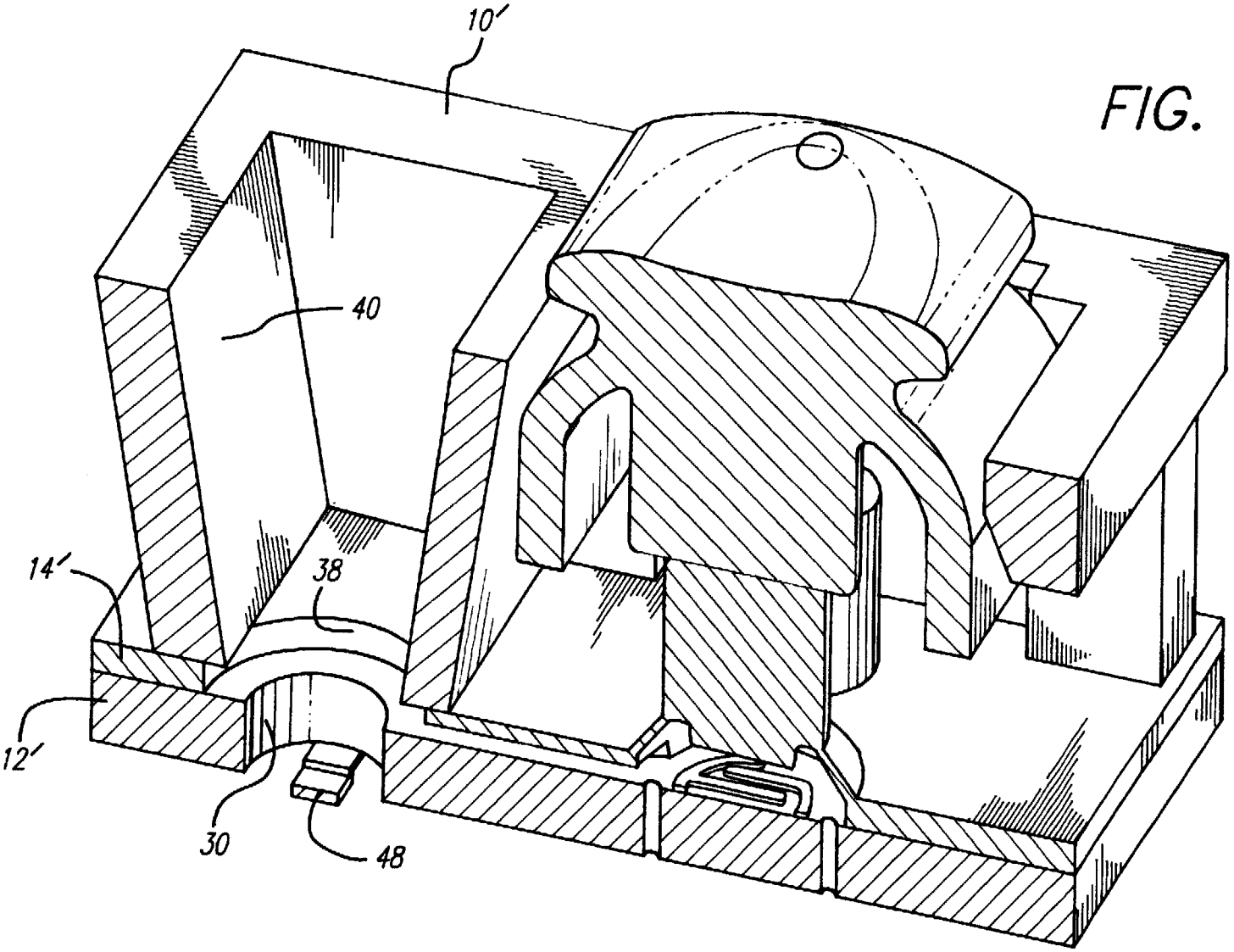
FIG. 6 is a length-wise cross sectional perspective of the assembled keycap unit in FIG. 5.

FIG. 6 shows a length-wise cross sectional view of the actuator keycap assembly of FIG. 5 taken along line B—B. In this perspective, backlight LED 48 is also shown mounted to the bottom surface of PCB 12'. Similarly, the light from backlight LED 48 emerges through hole 30 in PCB 12' and through the associated hole 38 in elastomer 14'. The light is then guided through light dam 40 which evenly spreads the light. The light then impinges on the back of a translucent legend overlay fitted across the light dam opening. Light dam 40 further serves the function of containing the light so that there is no cross bleeding into neighboring units.

The keyboard assembly of the present invention, when incorporated into a product such as medical ultrasound equipment, provides a relatively simple, efficient and streamlined method for providing improved user feedback. The combination of design features provides the option to incorporate multiple lighting modes within a keyboard assembly that is relatively inexpensive, long lasting, and does not significantly increase design complexity. Further, the backlit legends enhances the usability of system in low ambient light clinical environments during ultrasound exams, for example. Also, the backlit legends enhance contrast in high ambient light conditions for improved readability. The keycap indicator lights provide efficient real-time feedback about the state of function.

Although only one embodiment, in reference to medical ultrasound equipment, of the present invention has been described in detail, it should be appreciated that those skilled in the art will be able to make various modifications to the described subject matter without departing from the true spirit and scope of the invention. In particular, the inventive concept may be incorporated into other types of equipment used in various ambient lighting conditions that may benefit from multiple lighting modalities for improved feedback through the keyboard. Therefore the present examples are to be considered as illustrative and not restrictive, and the invention is not to be limited to the details given herein, but may be modified within the scope of the appended claims.

What is claimed is:

1. A keyboard assembly incorporating at least a first and a second lighting mode, the keyboard assembly comprising a plurality of actuator keys, said first lighting mode comprising an indicator light on each of the plurality of keys, and said second lighting mode comprising backlighted legends each in close proximity to and spaced from a corresponding one of the plurality of actuator keys and identifying an associated function of said corresponding one of the plurality of actuator keys.

2. A keyboard assembly as recited in claim 1 comprising LEDs embedded in the keyboard assembly, providing light sources for said lighting modes.

3. A keyboard assembly as recited in claim 1 wherein the legends are continuously backlighted.

4. A keyboard assembly as recited in claim 1 including any one of slider controls, knobs, and rocker switches.

5. A keyboard assembly as recited in claim 1 incorporated in medical ultrasound equipment.

6. A keyboard assembly comprising:

(a) a main bezel comprising a plurality of receptacles for retention and operation of a plurality of actuator keys, wherein each of the plurality of receptacles receives a single one of the plurality of actuator keys, said bezel further comprising a plurality of light dams wherein each of the plurality of light dams is proximate and associated with an individual one of the plurality of receptacles;

(b) a printed circuit board (PCB) having a top surface and a bottom surface, wherein said PCB further has a plurality of prealigned light holes formed therein such that a first plurality of backlight light emitting diodes (LEDs) and a second plurality of indicator LEDs are attached to the bottom surface of the PCB and aligned with corresponding light holes, and wherein said top surface of the PCB has a plurality of prearranged conductive switch pads thereon; and (c) a rubber-like elastomeric layer, sandwiched between the main bezel and the PCB, having a plurality of features formed therein, said features including, for each one of the plurality of actuator keys:

a dome responsive to said one actuator key such that when said one actuator key is depressed, the dome collapses and contacts an associated switch pad thereby generating a detectible signal;

a light passage hole for permitting transmission of light from an associated backlight LED through to an associated light dam; and a light boot for guiding light from an associated indicator LED into a light pipe, said light pipe having a first end slidably engaged in the boot and a second end press fitted into said one actuator key such that light can pass through the pipe and be observed through an opening in said one actuator key.

7. A keyboard assembly as recited in claim 6 including any one of slider controls, knobs, and rocker switches.

8. A keyboard assembly as recited in claim 6 wherein the switch pads are plated with an inert electrically conductive material such as gold.

9. A keyboard assembly as recited in claim 6 incorporated in medical ultrasound equipment.

10. A keyboard assembly as recited in claim 6, comprising backlighted legends, each in close proximity to and spaced from a corresponding one of the plurality of actuator keys, each said legend associated with a corresponding one of said plurality light dams, and wherein the legends are continuously backlighted.

11. A method of enhancing user feedback by incorporating at least two light modes in a keyboard assembly comprising the steps of:

providing a plurality of actuator keys each having a first light mode comprising an indicator light incorporated therein to indicate a state of an associated function; and providing a second light mode comprising a plurality of backlighted functionally descriptive legends proximate to and spaced from corresponding ones of said actuator keys such that said legends are logically associated with said actuator keys.

12. A method according to claim 11 wherein the state of the associated function is indicated by turning on the light when the function is available and off when the function is unavailable.

13. A method according to claim 11 wherein the descriptive legends are continuously lit to indicate a function associated with respective ones of said plurality of actuators keys.

14. A keyboard assembly having at least a first and a second lighting apparatus and a plurality of actuator keys, said first lighting apparatus comprising an indicator light associated with each of at least selected ones of the plurality of keys, and said second lighting apparatus comprising backlighted legends each in close proximity to and spaced from a corresponding one of the plurality of actuator keys and identifying an associated function of said corresponding one of the plurality of actuator keys.

15. A keyboard assembly as recited in claim 14 comprising LEDs embedded in the keyboard assembly, providing light sources for said lighting apparatuses.

16. A keyboard assembly as recited in claim 14 wherein the legends are continuously backlighted.

17. A keyboard assembly as recited in claim 14 including any one of slider controls, knobs, and rocker switches.

18. A keyboard assembly as recited in claim 14 incorporated in medical ultrasound equipment.

* * * * *